United States Patent [19]

Gazzarrini

[11] Patent Number: 4,649,838

[45] Date of Patent: Mar. 17, 1987

[54] PROCESS AND MACHINE FOR SEWING THE TOES OF PANTYHOSES WITH FEED FROM A MACHINE FOR FORMING PANTYHOSES AND WITH EJECTION SUITABLE FOR A SUBSEQUENT AUTOMATED TRANSFER OF THE PRODUCT

[75] Inventor: Vinicio Gazzarrini, Impruneta, Italy

[73] Assignee: Solis S.r.l., Florence, Italy

[21] Appl. No.: 535,856

[22] Filed: Sep. 26, 1983

[51] Int. Cl.[4] ..... D05B 21/00; D05B 33/00

[52] U.S. Cl. ..... 112/121.15; 223/43

[58] Field of Search ..... 112/121.15, 121.12, 112/121.11, 121.14; 223/112, 43, 42, 75, 76, 77

[56] References Cited

U.S. PATENT DOCUMENTS

| | | | |
|---|---|---|---|
| 3,738,294 | 6/1973 | Christiansen | 112/121.15 |
| 4,133,276 | 1/1979 | Selvi | 112/121.15 |
| 4,364,320 | 12/1982 | Nakhle et al. | 112/121.15 X |

*Primary Examiner*—H. Hampton Hunter

*Attorney, Agent, or Firm*—McAulay, Fields, Fisher, Goldstein & Nissen

[57] ABSTRACT

Apparatus for sewing the toes of pantyhose, including a transfer device to seize and transfer a garment from a first carrousel to a second carrousel, and in which a loading station of the first carrousel coincides with an ejector station of a pantyhose-forming machine with transfer of the pantyhose being carried out by a similar transfer device, and each of the carrousels have a plurality of arms, one of each of which is aligned with each other when transfer therebetween takes place. Each arm of the second carrousel includes two horizontal tubes having their free ends fitted with a transverse bar, and the tubes are rotatable around the longitudinal axis through contact of a lever attached to the tubes with a profile of a fixed cam concentric with the second carrousel.

21 Claims, 34 Drawing Figures

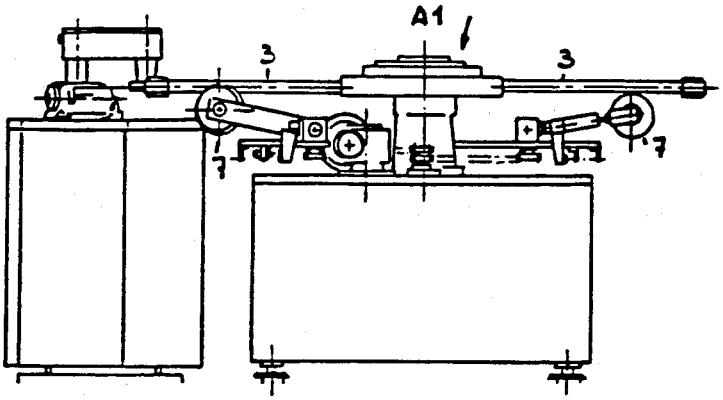
Fig. 3
Fig. 2
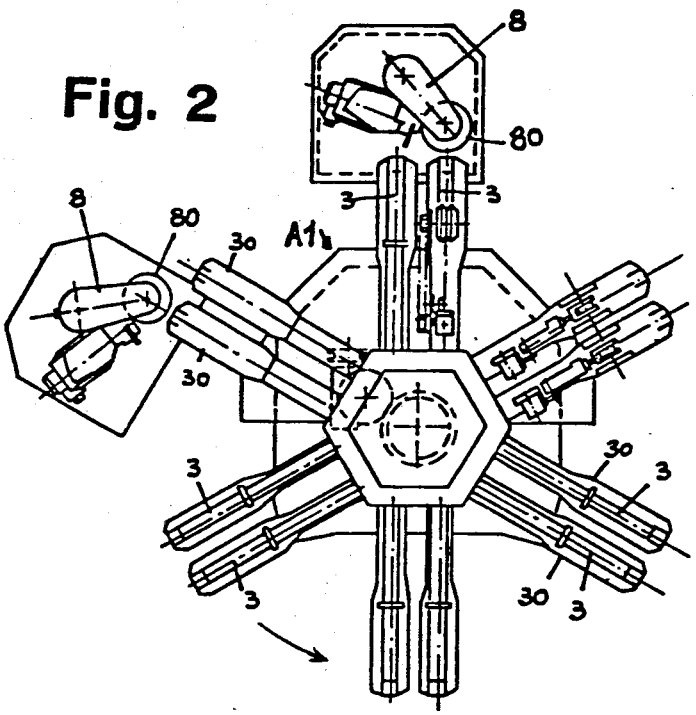

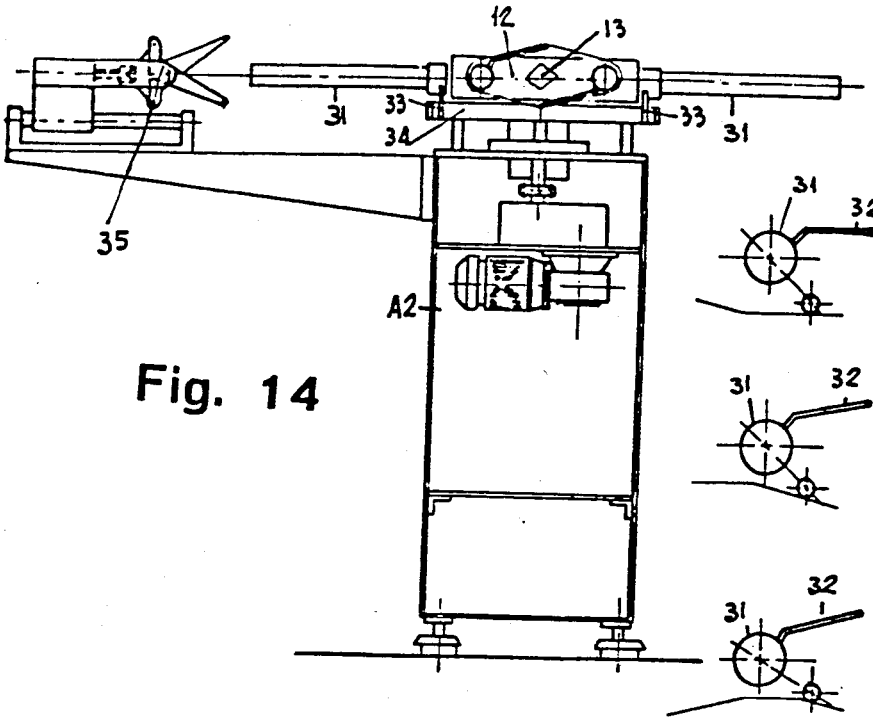
Fig. 14
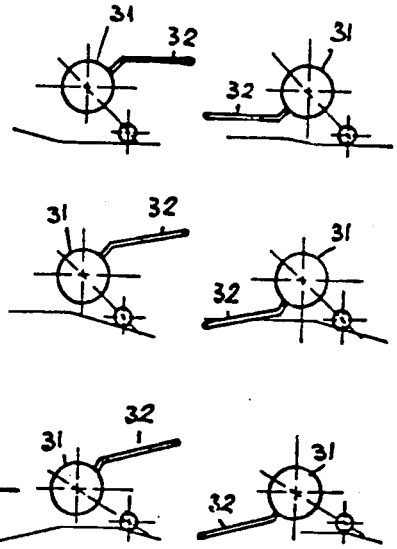
Fig. 15
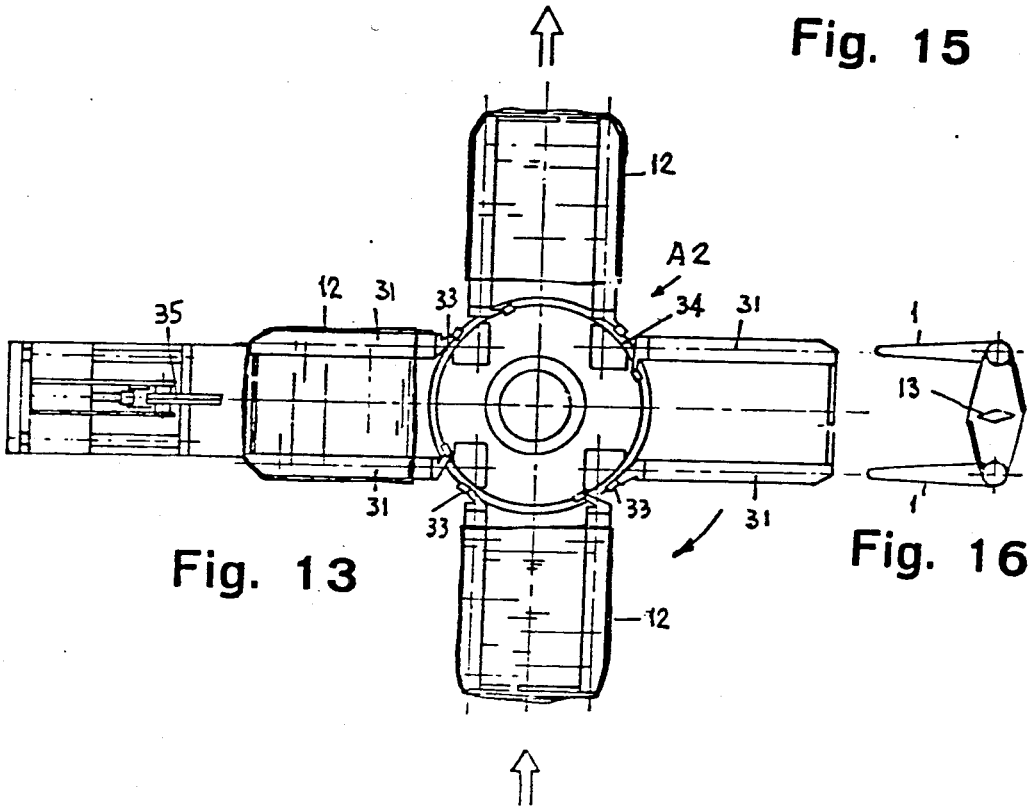
Fig. 13
Fig. 16

PROCESS AND MACHINE FOR SEWING THE TOES OF PANTYHOSES WITH FEED FROM A MACHINE FOR FORMING PANTYHOSES AND WITH EJECTION SUITABLE FOR A SUBSEQUENT AUTOMATED TRANSFER OF THE PRODUCT

SUMMARY

In order to automate the feed of a toe-sewing machine for pantyhoses and to permit simultaneously the automated feed of a pantyhose transfer device, use is made of a first carrousel (A1), with several arms and as many stations, and a second carrousel (A2), in a cascade arrangement with the first carrousel (A1), and also equipped with several arms and as many stations, where the loading station of the first carrousel (A1) coincides with the ejection station of a known machine (T) for forming pantyhoses and the ejection station of the second carrousel (A2) coincides with the loading station of pantyhose transfer device (G).

Each arm in the first carrousel (A1) is composed of two horizontal tubes (3), in order to receive inside the two legs, drawn in separately, and outside the reversed panty of the garment, which is transferred here from the machine (T) for forming the panty by means of a first transfer device (B1), operating at the loading station of the carrousel (A1) and equipped with two pincers (5) with horizontal prongs capable of opening out.

The second station of the first carrousel is equipped with devices to reverse the legs, positioning the toes to be sewn, and the third, or the third and the fourth stations are equipped with devices to sew separately, but either simultaneously or not, the toes of the two legs. After sewing the toes, the product is transferred onto an arm of the second carrousel (A2) by means of a second transfer device (B2)—similar to the first transfer device (B1)—operating at the ejection station of the first carrousel (A1).

Each arm in the second carrousel (A2) is composed of a pair of parallel horizontal tubes (31), capable of rotating around their longitudinal axis and equipped with a transverse bar (32) to stretch the product and enable it subsequently to be seized by a conveyor (G) through the opening in the garment to be fitted with the gusset.

The second station in the second carrousel (A2) is equipped with cutting devices (35), to make an opening eventually, if not present in the product.

DESCRIPTION

The invention concerns a process and a machine for sewing the toes of pantyhoses which comprises a direct and automated feed from a first machine, which machine sews the two stockings to form the panty of the pantyhose, which pantyhose is subsequently to be fitted with a gusset, and which further comprises an automated ejection mechanism suitable for a subsequent automated transfer of the garment, such as, for example, a transfer to a gusset-sewing machine.

From Spanish Pat. No. 504,417, an automatic device is already known which removes the garment from a machine which sews the two stockings to form the panty of the pantyhose, and then fit the panty with a gusset, and transfer it to a machine that sews the gussets. It is also known that before forming the pantyhose or after sewing the gusset it is necessary to sew the toes of the stockings by means of a further machine which until now has been fed manually.

The principal purpose of the present invention is to automate the feed operation of a machine for sewing the toes of the stockings and to make it possible for the subsequent sewing of the gusset, by means of a fully automated process.

This result has been achieved in conformity with the present invention by adopting the idea which consists in sewing the toes of a pantyhose by removing it from the machine which forms the pantyhose, that is, before sewing the gusset, and further in providing for the ejection of the pantyhose with the toes sewn in such manner as to make it possible to use a known device which transfers the garment to a gusset-sewing machine.

In conformity with the invention, the process comprises:

(A) transferring and positioning of the garment from the machine forming the panty (T) to a first carrousel of a toe-sewing machine (CP) by means of the following operations:
  - (a1) introducing and applying suction to the legs, separately, to suck the legs into two corresponding reversing tubes in the toe-sewing machine;
  - (a2) seizing and opening the waist of the panty and removal thereof from machine (T) and transfer thereof onto the tubes in the toe sewing machine (CP);

(B) reversing the legs and positioning the toes of the legs of the pantyhose relative to the tubes to enable them subsequently to be properly sewn; and after sewing the two toes; and (C) transferring and positioning of the garment from the first to the second carrousel in the toe sewing machine (CP) by means of the following operations:
  - (c1) suctioning of the toes of the pantyhose into their respective tubes; and
  - (c2) seizing and opening the waist of the panty and removal and transfer and arrangement thereof toward a known device (G), which transfers the garment to a gusset-sewing machine (S).

And the machine to carry out the process according to the invention comprises:

means to draw the legs of the garment that is placed on machine (T) into two reversing tubes in machine (CP);

means to remove from panty forming machine (T) the panty of the garment by its waist by means of pincers with parallel outward-spreading prongs;

means to transfer the panty onto the reversing tubes in (CP);

means to reverse the legs and position the toes in the toe-sewing position;

means to sew the toes; and means to remove the panty from the reversing tubes and position it relative to a known garment transfer or conveyor device (G), which transfers the garment to a gusset-sewing machine.

The advantages of the present invention essentially consist in that the sewing is applied to the toes of the two stockings which form a pantyhose to sew the toes; that the sewing of the toes is possible both for pantyhoses with seams, with or without a gusset, and for seamless ones, that is, those pantyhoses formed in a single piece, without or with gusset; that the feed of the pantyhoses with seams is automated and simultaneous with their production; that the sewing of two toes is simultaneous or not, depending on whether two or one cutting and sewing machines are used; that the ejection of the pantyhoses is automated.

These and further advantages and features of the invention will be more fully and better understood by any expert in the field from the following description and with the aid of the attached explanatory drawings, not to be regarded as limiting its scope, wherein:

BRIEF DESCRIPTION OF THE DRAWINGS

FIG. 2 shows a detail plan view of the carrousel in section (A1) of a toe-sewing machine according to the invention;

FIG. 3 shows a front view of the detail in FIG. 2;

FIG. 13 shows a detail plan view of a garment-ejection device for a toe-sewing machine according to the invention;

FIG. 14 shows a front view of the detail in FIG. 13;

FIG. 15 shows an enlarged detail view of the garment-stretching device for the ejection device in FIG. 13; and FIG. 16 shows a detail view of the product with the opening made by cutting devices.

DESCRIPTION OF THE PREFERRED EMBODIMENTS

Figure 6:
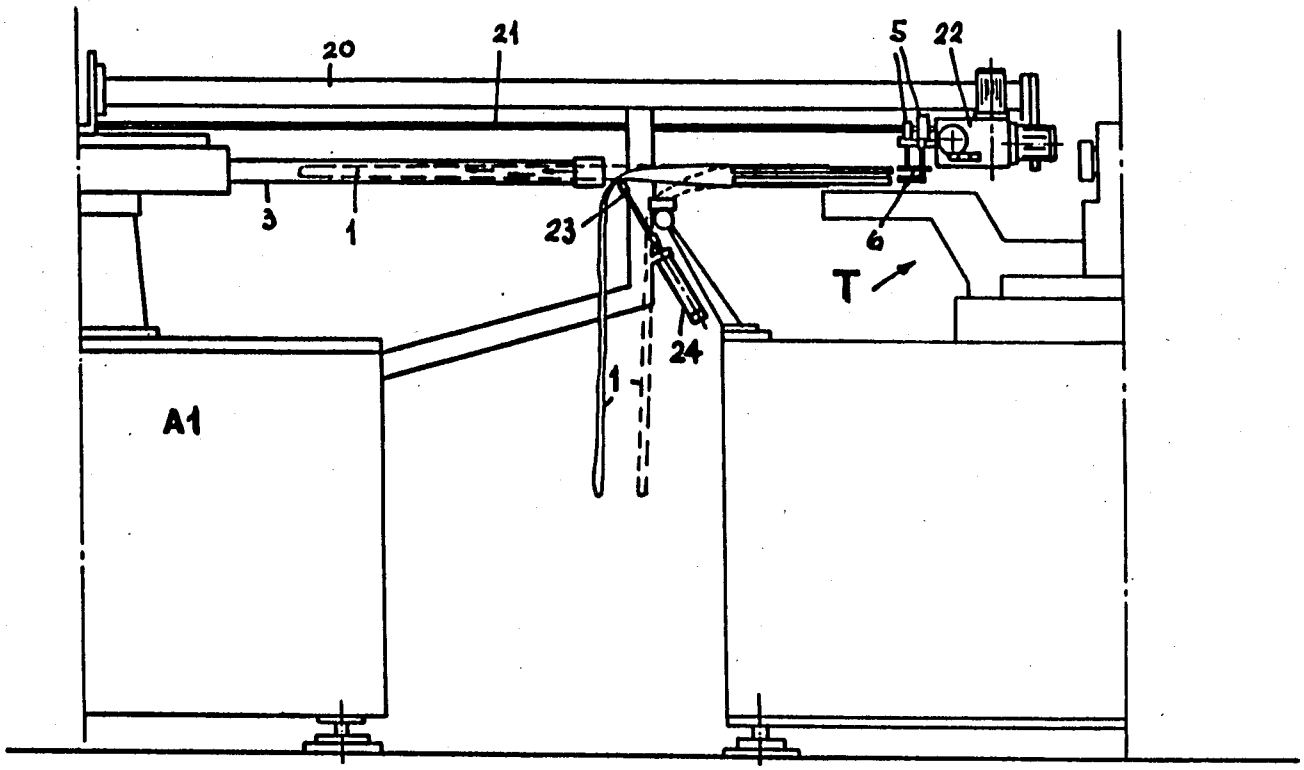
FIG. 6 shows a detail side view of the device that transfers the garment from a machine (T) which produces the pantyhoses with seams to a toe-sewing machine according to the invention in the starting position.
Figure 7:
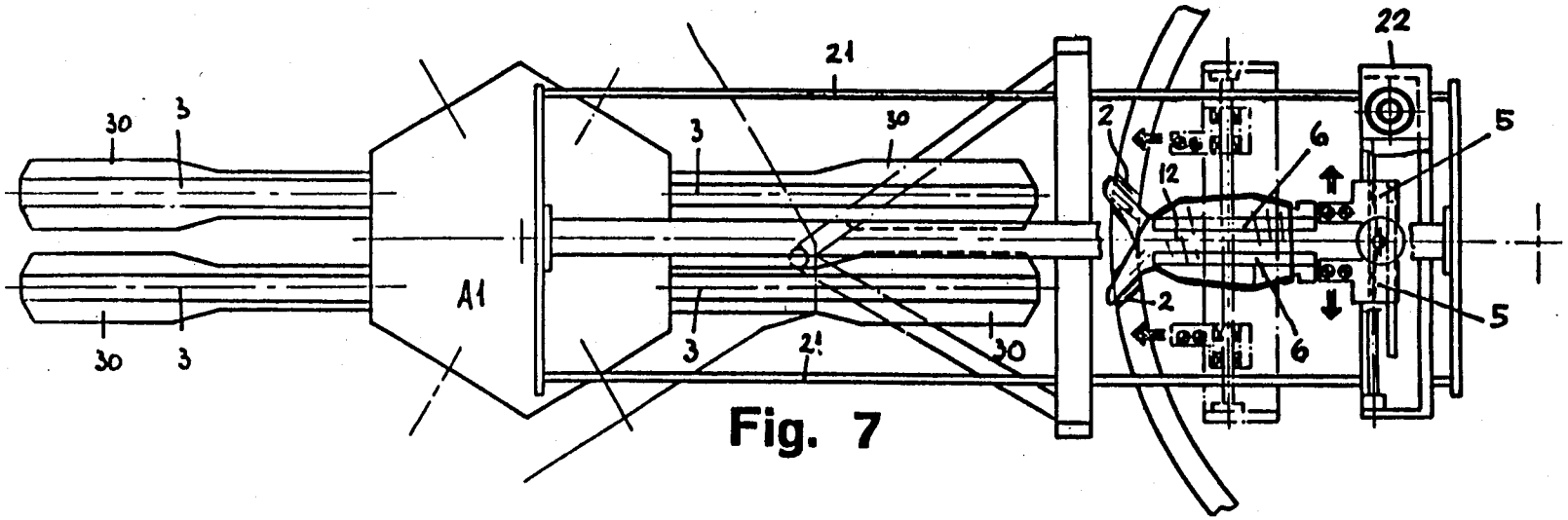
FIG. 7 shows an enlarged plan view of the detail in FIG. 6.
Figure 8:
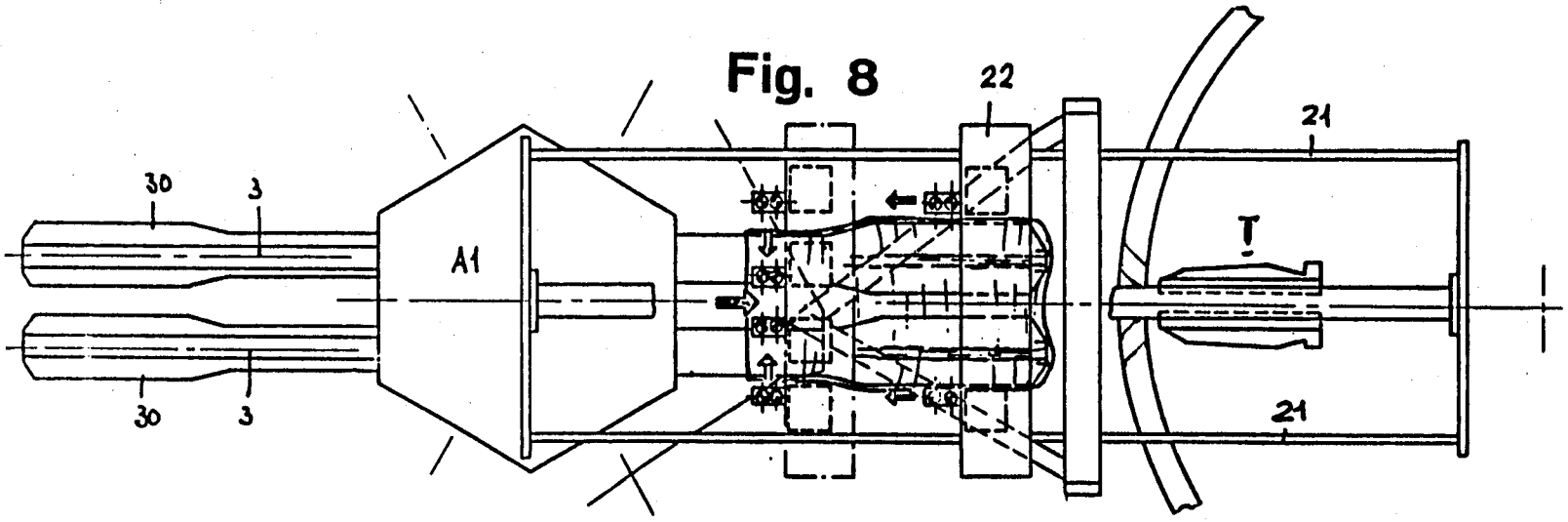
FIG. 8 shows an enlarged plan view of the detail in FIG. 6 in its final position.
Figure 10A:
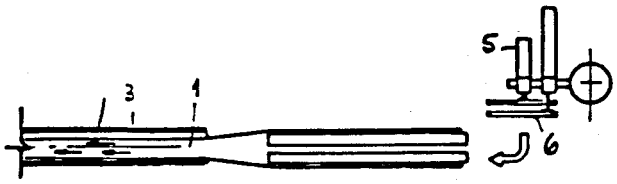
FIGS. 9A through 9F and 10A through 10F show front and side views of the sequence of positions of the transfer device during the removal of the garment from a pantyhose-manufacturing machine.
Figure 9A:
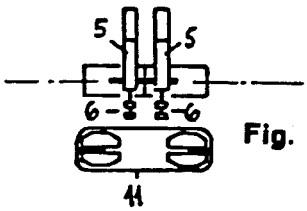
Figure 10B:
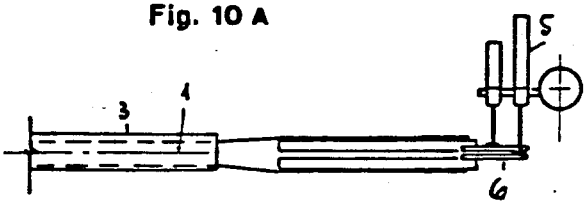
Figure 9B:
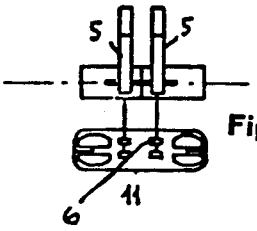
Figure 10C:
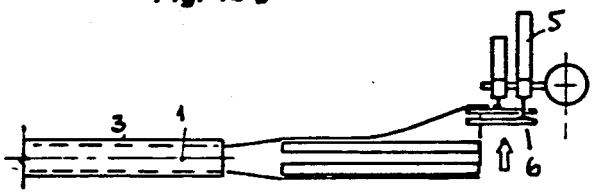
Figure 9C:
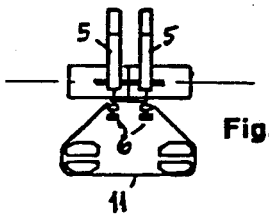
Figure 10D:
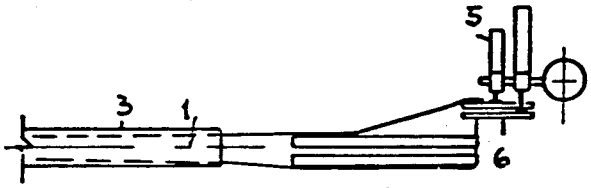
Figure 9D:
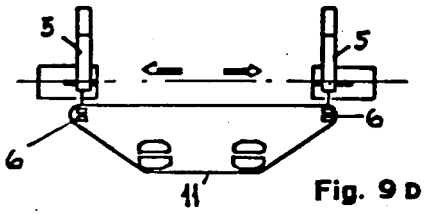
Figure 10E:
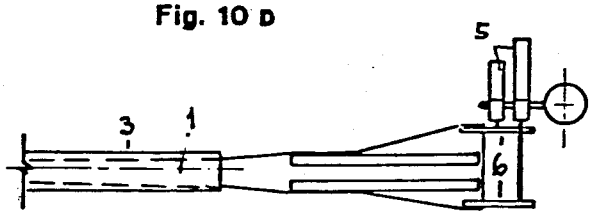
Figure 9E:
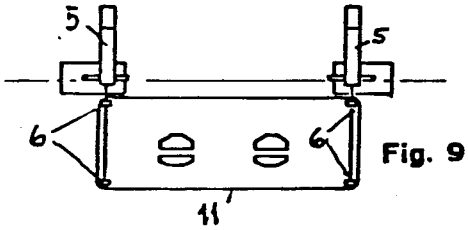
Figure 10F:
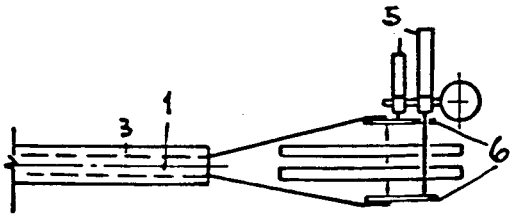
Figure 9F:
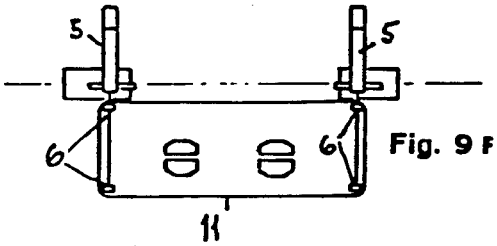
Figure 12A:
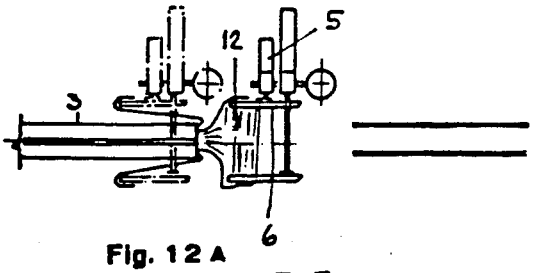
FIGS. 11A through 11E and 12A through 12E show front and side views of the sequence of positions of said transfer device while placing the garment onto a toe-sewing machine according to the invention.
Figure 12B:
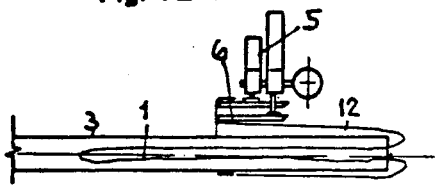
Figure 12C:
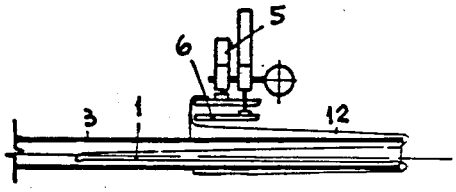
Figure 12D:
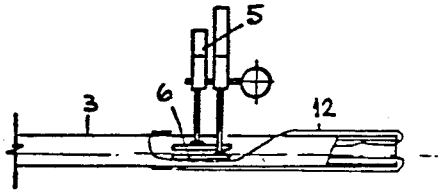
Figure 12E:
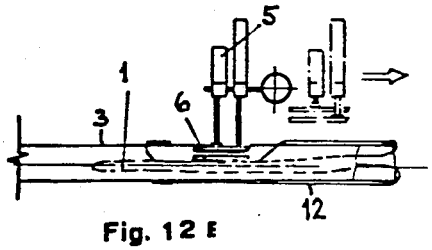
Figure 11A:
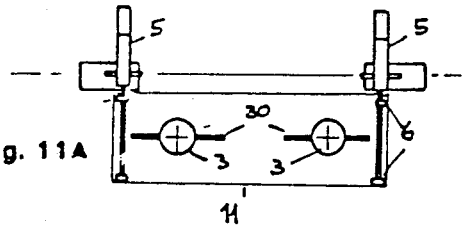
Figure 11B:
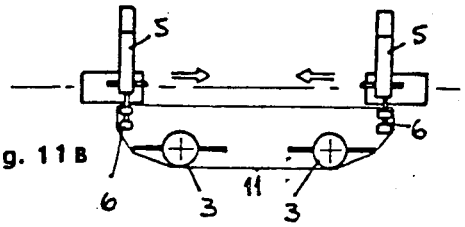
Figure 11C:
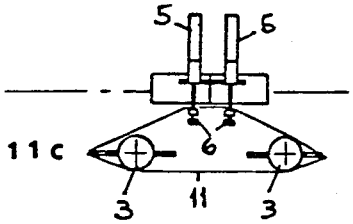
Figure 11D:
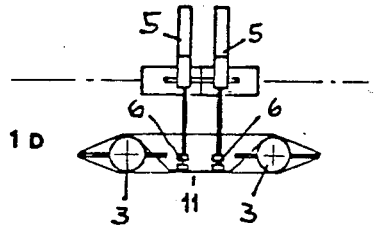
Figure 11E:
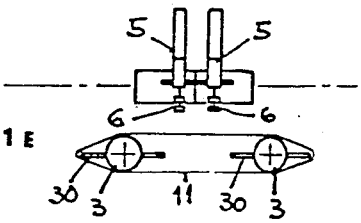

In its basic form and with reference to the attached drawings, the process covered by the present invention comprises:

A first manual stage during which the two leg portions of the stocking (1) of the finished garment are placed spread out on two corresponding grooves (2) see FIG. 2 in the garment-forming machine, for the purpose of facilitating the start of the subsequent fully-automated stages, which involve:

Bringing the stockings (1) close to two corresponding reversing tubes (3) see FIG. 6 by means of two pneumatically-operated forks (23), for the purpose of facilitating their subsequent introduction;

Suctioning of the stockings (1) into the reversing tubes (3);

The stretching and opening into a rectangular shape of the waist (11) of the product still held by the machine (T) by means of two horizontally-moving pincers (5) and vertically-moving horizontal prongs (6), to obtain the detachment of the panty (12) from the machine (T);

The removal of the panty from machine (T) and simultaneous positioning with reversal on the tubes (3) of the toe-sewing machine by means of the same said pincers (5);

Reversing the legs of the garment on the tubes with an accurate positioning of the toes by means of friction rollers (7) for the purpose of permitting a proper sewing of the toes;

Bringing the toes to be sewn, separately, close to two corresponding cutting-sewing machines (8);

Separately sewing of the two toes;

Removing the panty (12) from the tubes (3) of an arm in the first carrousel (A1) and simultaneous positioning and straightening on the tubes (31) of an arm see FIGS. 13 and 14, in the second carrousel (A2) by means of two horizontally-moving pincers (51) and vertically-moving horizontal prongs (61); and Stretching of the panty (12) by rotating the tubes (31) and positioning of the garment to enable it to be seized by a conveyor device (G) through the opening (13) left in the garment to receive the gusset; and Eventually, cutting in the crotch area of the garment to form an opening (13), if missing, in the product.

Figure 1:
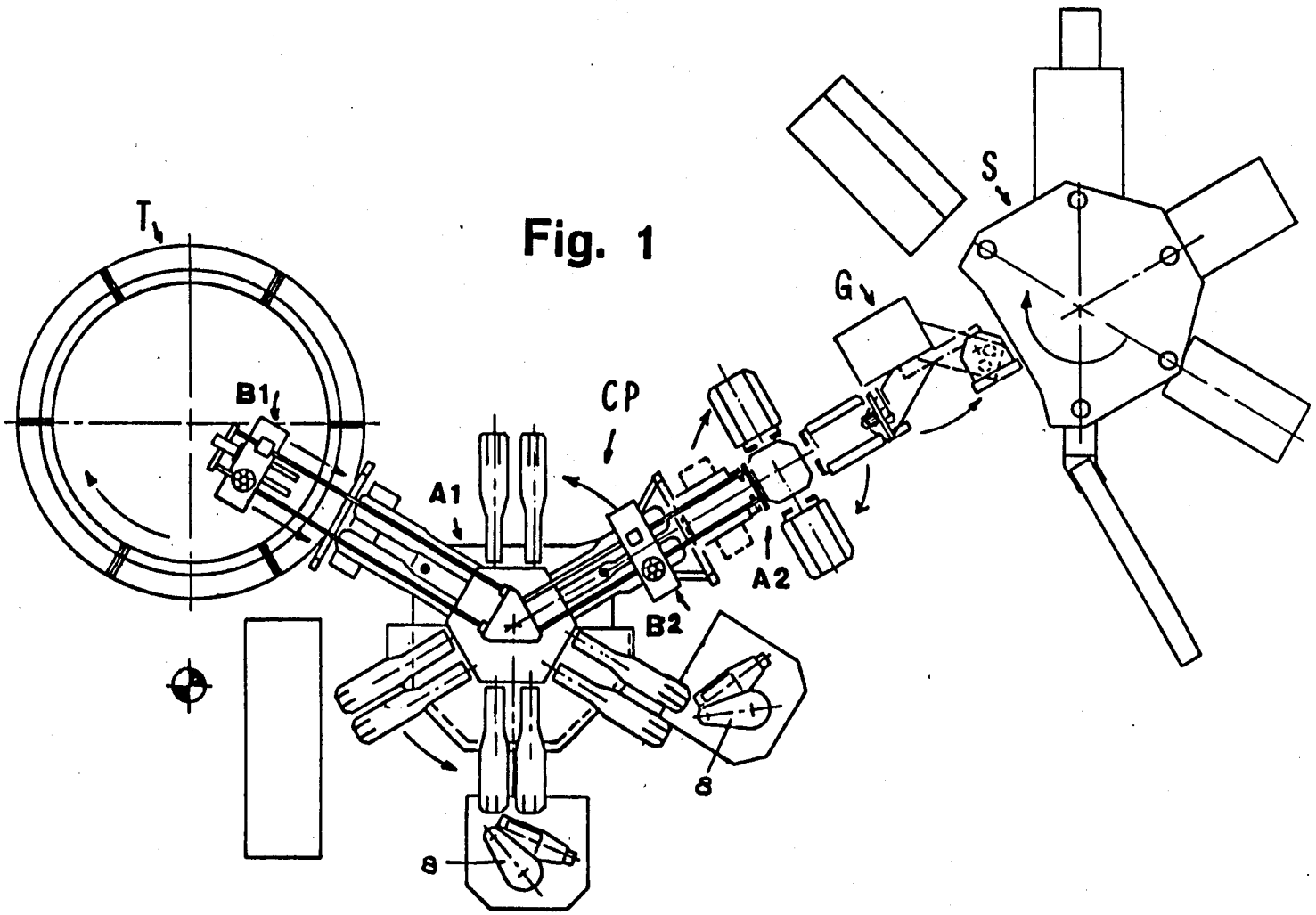
FIG. 1 shows a plan view of a combination of a known machine (T), which produces pantyhoses with seams, with the two secions (A1–A2) of a toe-sewing machine according to the invention fed by the machine (T), with a known device (G) which transfers the pantyhoses from the toe-sewing machine to a known gusset-sewing machine, and with a gusset-sewing machine (S)

Concerning the machine according to the invention to carry out the process and with reference to the attached drawings, essentially it comprises:

A first section or a first carrousel (A1) with a horizontally-rotating hexagonal-base turret, with stops at as many stations, from each face of which turret there project two parallel horizontal tubes (3), equipped with pneumatic suction and also fitted with two horizontal side wings (30), moving in a longitudinal direction toward the outside of the carrousel;

As best seen in FIGS. 1 and 6, first garment transfer device (B1) operating in front of the loading station of the toe sewing machine (CP) and composed of a fixed horizontal load-bearing structure (20), located above and extending radially and projecting toward the outside relative to the carrousel (A1); parallel to the structure (20) there is attached a running track (21) for a carriage (22) bearing two pincers (5), moving horizontally in different directions, transversely relative to the running track (21), each of which pincers is equipped with two horizontal and superimposed prongs (6), moving vertically, by means of corresponding pneumatic cylinders; the carriage (22) is equipped with known means for its translation and for that of the pincers (5);

Two forks (23) underneath the transfer device and are operated by corresponding pneumatic cylinders (24), with an active stroke toward the inlets of the tubes (3), for the purpose of collecting the legs (1) of the garment hanging from the machine (T) and bringing them close to the inlets;

Known means (see FIG. 2) to bring the wings (30) of the tubes (3) with the overhanging legs of the garment close to the corresponding cutting-sewing machines (8);

Known means (8) to sew the toes of the legs;

A second garment transfer device (B2), operating in front of the ejection station of the first carrousel (A1) and similar in all respects to the previous one (B1);

A second section or second carrousel (A2) with four arms, (see FIG. 13) rotating horizontally, with stops at as many stations, one of which is in front of the fifth station of the above-mentioned first carrousel (A1); each arm is composed of two horizontal and parallel tubes (31), rotating around their longitudinal axis and with their free ends equipped with a transverse bar (32) (see FIG. 15) pointing toward the opposite tube; to each one of the tubes (31) there is also attached a lever (33), whose end, by contacting the profile of a cam (34) attached concentrically to the carrousel (B2) causes—during the rotation of the carrousel and before the ejection station—the rotation of the tube (31) and simultaneously the opening out of the bar (32).

The second station in the second carrousel (A2) comprises cutting devices (35) to make, eventually, the opening (13), if not present, in the product.

The operation is as follows.

Figure 4:
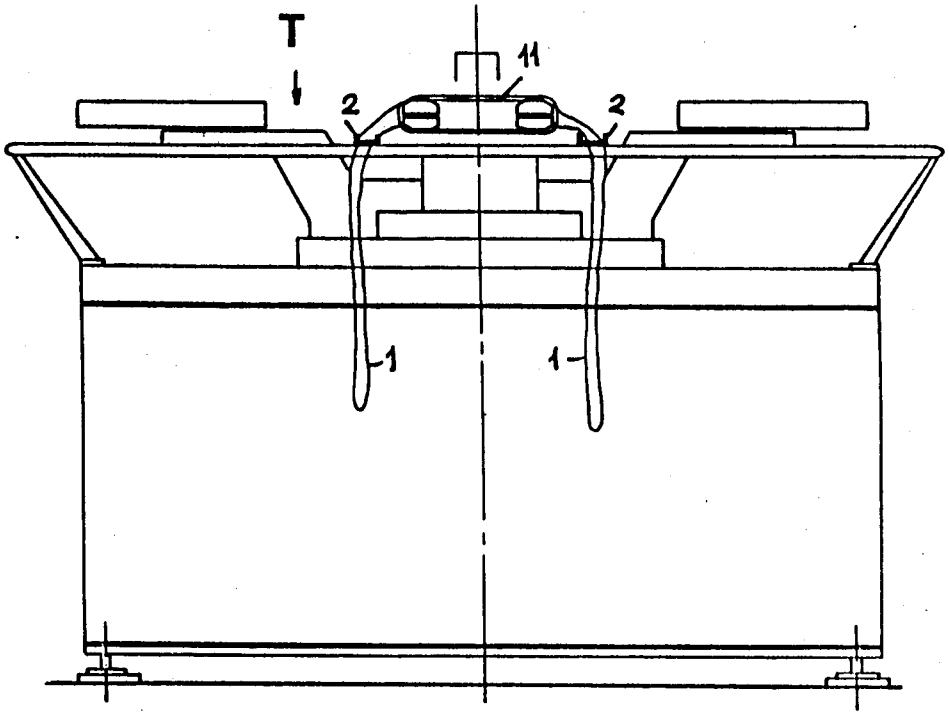
FIG. 4 shows a detail front view of a machine (T) which produces the pantyhoses with seam with the finished garment.
Figure 5:
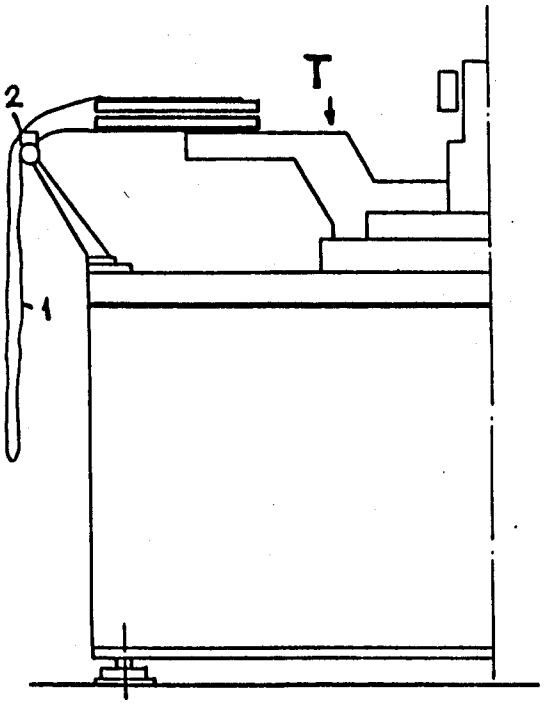
FIG. 5 shows a side view of the detail in FIG. 4.

The cycle begins with the product in the position shown in FIGS. 4 and 5 and with the first transfer device (B1) in the position shown in FIG. 6 in the attached drawings.

Referring now more particularly to FIGS. 9 to 12, after the legs (1) of the garment have been brought close to the inlets of the tubes (3) in the first carrousel (A1), and there drawn in continuously, the panty forming transfer device (B1) goes into action to release and remove from the machine (T) the panty (12) of the garment, introducing into it the prongs (6) through the open area of the waist (11), and then lifting and stretching the upper edge and subsequently lowering and stretching the lower one, thereby obtaining a rectangular shape, as shown in FIGS. 9A through 9F and 10A through 10F in the attached drawings; subsequently, the carriage (22) moves toward and above the tubes (3) of an arm of the carrousel (A1)—which is aligned with that of the machine (T) which holds the garment—covering them with the above-mentioned panty as the latter is reversed as shown in FIGS. 11A through 11E and 12A through 12E in the attached drawings.

At this point, the carriage (22) moves back to its starting position and the carrousel (A1), rotating counterclockwise, moves the tubes (3) with the panty to the next station, where the legs of the garment, by means of the rollers (7), are reversed and the toes positioned on the tubes (3), to present their free ends in the proper position to undergo the subsequent sewing; the sewing, which takes place at the third station for the first leg and at the fourth station for the second leg, follows the outward translation of the wings (30) and the locking of the toe of the stocking by pincers (80). At the fifth station, the second transfer device (B2)—with operations that are the reverse of those performed at the first station—proceeds to transfer the panty of the garment onto the tubes (31) of an arm of the second carrousel (A2); subsequently, the panty of the garment is stretched and positioned so that, at a subsubsequent station, it becomes possible to remove it by means of a known transfer and conveyor device (G) through the opening (13) in the garment to be fitted with the gusset.

If the garment has no such opening (13), because it is in a single piece, seamless, the opening is then made by means of cutting devices (35) located at the second station in the second carrousel (A2).

In practice, the details of execution may vary equally anyway with respect to the shape, size, arrangement of the components, and nature of the materials used, without thereby departing from the spirit of the solution adopted, and therefore remaining within the scope of the protection granted under the present patent for industrial invention.

I claim:

1. Machine for sewing the toes of pantyhoses, comprising:

first and second sections in combination;

said first section comprising:

a first carrousel with several arms rotating horizontally past a plurality of stations with stops at said stations;

a first device for seizing and transferring the garment from a machine for forming the panty to said first carrousel; and at least one cutting-sewing machine;

said second section comprising:

a second carrousel with several arms, rotating horizontally and having stops at each station;

said second carrousel being juxtaposed to the first carrousel and the stops of said second carrousel being synchronized with the stops of the first carrousel and one of the arms of said second carrousel being aligned with a corresponding arm in the first carrousel;

a second device to seize and transfer the garment from said first carrousel to said second carrousel; and each arm of said second carrousel including two horizontal contiguous oppositely facing tubes each having their free ends fitted with a transverse bar facing the opposite tube; and said tubes being rotatable around their longitudinal axis through the contact of a lever attached to said tubes with the profile of a fixed cam, concentric with said second carrousel.

2. Machine according to claim 1, wherein:

said first carrousel comprises six stations, a first one of said stations for loading the garment, a second for reversing the legs and positioning their respective toes to be sewn, a third and fourth for the separate, but simultaneous, sewing of the toes, a fifth for ejecting the garment, and a sixth for servicing.

3. Maching according to claim 1, wherein:

said first and second transfer devices each comprise a fixed, bracket-like structure, bearing a straight track, parallel and above two contiguous tubes of an arm of said first carrousel, in front of two different stations and projecting beyond the inlet of the tubes;

a carriage movable alternately on said track and bearing two pincers horizontally movable transversely relative to said track and in opposite directions; and said pincers including two horizontal superimposed prongs each capable of vertical travel, together or independently.

4. Machine according to claim 1, wherein said second carrousel comprises four stations, a first station for loading, a second station for eventually forming the opening, and a third station for the ejection of the garment.

5. Machine according to claim 1, wherein said second carrousel comprises at least three stations including a loading station and an ejection station.

6. Machine according to claim 1, including pneumatic cylinders for moving said pincers vertically.

7. Machine according to claim 1, wherein said cam is attached concentrically to said second carrousel.

8. Machine according to claim 4, wherein said second station includes cutting devices.

9. Apparatus for sewing the toes of pantyhoses, comprising:

first and second sections each including a carrousel;

said first section carrousel including:

several arms rotating horizontally past a plurality of stations with stops at said stations;

a first device for seizing and transferring the garment from a machine for forming the panty, after the legs of a pantyhose garment have been separated, to said first carrousel and including a fixed load-bearing structure located externally of said first section and projecting towards the outside relative to said first section;

said first carrousel including means for moving the legs of the pantyhose to a position for the sewing of the toes thereof and then reversing the panty of the pantyhose garment; and at least one cutting-sewing machine;

a second device to seize and transfer the garment from said first carrousel to the second section carrousel, including means in the machine for removing the garment with the toes thereof sewn and transferring the garment to said second carrousel;

said second section carrousel including:

means and several arms, rotating horizontally and having stops at each station juxtaposed to said first carrousel and synchronized with each stop of said first carrousel;

said second carrousel being provided with an arm aligned with a corresponding arm in said first carrousel for straightening the panty, stretching the area of fabric around an opening to be fitted with a gusset and positioning the garment on a conveyor device; and each arm of said second carrousel including two horizontal contiguous differently facing tubes each having their free ends fitted with a transverse bar facing another of the differently facing tubes; and said tubes being rotatable around the longitudinal axis through the contact of a lever attached to said tubes, with the profile of a fixed cam, concentric with said second carrousel.

10. Apparatus according to claim 9, wherein:

said first carrousel comprises six stations, a first one of said stations for loading the garment, a second station for reversing the legs and positioning their respective toes to be sewn, a third station and a fourth station for the separate, but simultaneous, sewing of the toes, a fifth station for ejecting the garment, and a sixth station for servicing; and said second carrousel comprises at least two stations, one for eventually forming the opening, and another for the ejection of the garment.

11. Apparatus according to claim 9, wherein:

said first and said second transfer devices each comprise a fixed, bracket-like structure, bearing a straight track, parallel and above two contiguous tubes of an arm of said first carrousel, in front of two different stations and projecting beyond the inlets of the pipes;

a carriage movable alternately on said track and bearing two pincers horizontally movable transversely relative to said track and in different directions; and said pincers including two horizontal superimposed prongs each capable of vertical travel, together or independently.

12. A machine for sewing the toes of pantyhoses, wherein the pantyhose is automatically fed from a pantyhose forming apparatus to a toe closing apparatus in a single feed line and then to a gusset sewing apparatus, comprising:

first and second sections in combination with said pantyhose forming apparatus;

said first section comprising:

a first carrousel with several arms rotating horizontally past a plurality of stations with stops at each said stations, one of said stops being aligned with said pantyhose forming apparatus and another of said stops being aligned with said gusset sewing apparatus;

a first device carried by said first carrousel for seizing and transferring the garment from said pantyhose forming apparatus for forming the panty to said first carrousel; and at least one cutting-sewing machine; and said second section comprising:

a second carrousel with several arms, rotating horizontally and having stops at each station;

a second device automatically to seize and transfer the garment from said first carrousel to the second carrousel;

said first carrousel having one stop juxtaposed to a stop of the second carrousel and the juxtaposed stops of said first and said second carrousels being synchronized with each other, and the arm on said second carrousel juxtaposed to the arm on said first carrousel at said juxtaposed stops being aligned with each other for transferring the garment with the closed toes to said second carrousel from said first carrousel.

13. Apparatus according to claim 12, wherein:

each arm of said second carrousel includes two horizontal contiguous oppositely facing tubes each having their free ends fitted with a transverse bar facing the opposite tube; and said tubes being rotatable around their longitudinal axis through the contact of a lever attached to said tubes, with the profile of a fixed cam, concentric with said second carrousel.

14. Machine according to claim 12, wherein:

said first carrousel comprises six stations, a first one of said stations for loading the garment, a second for reversing the legs and positioning their respective toes to be sewn, a third and a fourth for the separate, but simultaneous, sewing of the toes, a fifth for ejecting the garment, and a sixth for servicing.

15. Apparatus according to claim 12, wherein:

said first and second transfer devices each comprise a fixed, bracket-like structure, bearing a straight track, parallel and above two contiguous tubes of an arm of said first carrousel, in front of two different stations and projecting beyond the inlets of the tubes;

a carriage movable alternately on said track and bearing two pincers horizontally movable transversely relative to said track and in opposite directions; and said pincers including two horizontal superimposed prongs each capable of vertical travel, together on independently.

16. Apparatus according to claim 12, wherein said second carrousel comprises at least a first station for loading, a second station for eventually forming the opening, and a third station for the ejection of the garment.

17. Machine according to claim 12, wherein said second carrousel comprises at least a loading station and an ejection station.

18. Machine according to claim 13, wherein:

said first carrousel comprises a first station for loading the garment, a second station for reversing the legs and positioning their respective toes to be sewn, third and fourth stations for the separate, but simultaneous, sewing of the toes, a fifth station for ejecting the garment, and a sixth station for servicing.

19. Apparatus according to claim 18, wherein:

said first and said second transfer devices each comprise a fixed, bracket-like structure, bearing a straight track, parallel and above two contiguous tubes of an arm of said first carrousel, in front of two different stations and projecting beyond the inlets of the tubes;

a carriage movable alternately on said track and bearing two pincers horizontally movable transversely relative to said track and in opposite directions; and said pincers including two horizontal superimposed prongs each capable of vertical travel, together or independently.

20. Apparatus according to claim 19, wherein said second carrousel comprises a first station for loading, a second station for eventually forming the opening, and a third station for the ejection of the garment.

21. Machine according to claim 20, wherein said second carrousel comprises at least a loading station and an ejection station.

* * * * *